US010941456B2

(12) United States Patent
Tada et al.

(10) Patent No.: US 10,941,456 B2
(45) Date of Patent: Mar. 9, 2021

(54) STEEL SHEET FOR CAN AND METHOD FOR MANUFACTURING THE SAME

(71) Applicant: JFE STEEL CORPORATION, Tokyo (JP)

(72) Inventors: Masaki Tada, Tokyo (JP); Katsumi Kojima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/080,067

(22) PCT Filed: Feb. 2, 2017

(86) PCT No.: PCT/JP2017/003748

§ 371 (c)(1),
(2) Date: Aug. 27, 2018

(87) PCT Pub. No.: WO2017/150066

PCT Pub. Date: Sep. 8, 2017

(65) Prior Publication Data

US 2019/0062859 A1 Feb. 28, 2019

(30) Foreign Application Priority Data

Feb. 29, 2016 (JP) ..... JP2016-038201

(51) Int. Cl.

| | |
|---|---|
| ***C21D 8/02*** | (2006.01) |
| ***C21D 9/46*** | (2006.01) |
| ***C22C 38/12*** | (2006.01) |
| ***C21D 1/26*** | (2006.01) |
| ***C21D 8/04*** | (2006.01) |
| ***C21D 1/32*** | (2006.01) |
| ***C22C 38/00*** | (2006.01) |
| ***C22C 38/04*** | (2006.01) |
| ***C21D 9/48*** | (2006.01) |

(52) U.S. Cl.

CPC ..... *C21D 8/0263* (2013.01); *C21D 1/26* (2013.01); *C21D 1/32* (2013.01); *C21D 8/0421* (2013.01); *C21D 8/0426* (2013.01); *C21D 8/0436* (2013.01); *C21D 8/0468* (2013.01); *C21D 9/46* (2013.01); *C21D 9/48* (2013.01); *C22C 38/001* (2013.01); *C22C 38/04* (2013.01); *C22C 38/12* (2013.01)

(58) Field of Classification Search

None

See application file for complete search history.

(56) References Cited

U.S. PATENT DOCUMENTS

| | | | | |
|---|---|---|---|---|
| 2010/0116832 | A1* | 5/2010 | Nishihara | C21D 9/46 220/669 |
| 2011/0076177 | A1 | 3/2011 | Aratani et al. | |
| 2015/0017469 | A1 | 1/2015 | Sauer et al. | |
| 2015/0136635 | A1* | 5/2015 | Tada | C22C 38/00 413/1 |

FOREIGN PATENT DOCUMENTS

| | | | |
|---|---|---|---|
| CA | 2860090 | A1 | 6/2013 |
| CN | 1116249 | A | 2/1996 |
| CN | 103649353 | A | 3/2014 |
| CN | 104011230 | A | 8/2014 |
| EP | 1741800 | A1 | 1/2007 |
| EP | 2 138 596 | A1 | 12/2009 |
| EP | 2128289 | A1 | 12/2009 |
| EP | 2138596 | A1 | 12/2009 |
| EP | 2 860 124 | A1 | 4/2015 |
| JP | H07-62486 | A | 3/1995 |
| JP | H08-325670 | A | 12/1996 |
| JP | H11315343 | A | 11/1999 |
| JP | 2001-89828 | A | 4/2001 |
| JP | 2001-107187 | A | 4/2001 |
| JP | 2003013146 | A | 1/2003 |
| JP | 2004-183074 | A | 7/2004 |
| JP | 2005-350737 | A | 12/2005 |
| JP | 2008-138234 | A | 6/2008 |
| JP | 2008-214658 | A | 9/2008 |
| JP | 2009-007607 | A | 1/2009 |

(Continued)

OTHER PUBLICATIONS

May 9, 2019 Office Action issued in Australian Application No. 2017227455.
March 2, 2020 Office Action issued in U.S. Appl. No. 15/307,892.
Jan. 28, 2019 Extended Search Report issued in European Application No. 17759537.8.
Jul. 3, 2017 Office Action issued in Taiwanese Application No. 106105032.
Aug. 26, 2019 Office Action issued in U.S. Appl. No. 15/307,892.
Apr. 25, 2017 International Search Report issued in International Application No. PCT/JP2017/003748.
Oct. 15, 2019 Office Action issued in Canadian Patent Application No. 3,012,447.
Oct. 21, 2019 Office Action issued in Chinese Patent Application No. 201780013649.9.
Sep. 19, 2019 Office Action issued in Korean Patent Application No. 10-2018-7024581.

(Continued)

*Primary Examiner* — Anthony J Zimmer
*Assistant Examiner* — Anthony M Liang
(74) *Attorney, Agent, or Firm* — Oliff PLC

(57) ABSTRACT

A steel sheet for a can having high strength, excellent ductility, and good corrosion resistance, and a method for manufacturing the steel sheet. The steel sheet has a chemical composition containing, by mass %, C: 0.020% or more and 0.130% or less, Si: 0.04% or less, Mn: 0.10% or more and 1.20% or less, P: 0.007% or more and 0.100% or less, S: 0.030% or less, Al: 0.001% or more and 0.100% or less, N: more than 0.0120% and 0.0200% or less, Nb: 0.0060% or more and 0.0300% or less, and Fe and inevitable impurities. An absolute value of a difference in an amount of solid solution Nb between a region from a surface to a position located at ⅛ of a thickness and a region from a position located at ⅜ of the thickness to a position located at ⅝ of the thickness is 0.0010 mass % or more.

4 Claims, No Drawings

(56) References Cited

FOREIGN PATENT DOCUMENTS

| | | | |
|---|---|---|---|
| JP | 2013-028842 | A | 2/2013 |
| JP | 2013-032596 | A | 2/2013 |
| KR | 20100029132 | A | 3/2010 |
| WO | 2005/103316 | A1 | 11/2005 |
| WO | 2008/105524 | A1 | 9/2008 |
| WO | 2009/123356 | A1 | 10/2009 |

OTHER PUBLICATIONS

Nov. 29, 2019 Office Action issued in European Patent Application No. 17759537.8.
Jul. 30, 2020 Office Action issued in Chinese Patent Application No. 201780013649.9.
Apr. 26, 2020 Office Action issued in Chinese Patent Application No. 201780013649.9.

* cited by examiner

STEEL SHEET FOR CAN AND METHOD FOR MANUFACTURING THE SAME

TECHNICAL FIELD

The present disclosure relates to a steel sheet for a can which is used as a material for, for example, a three-piece can which is formed by performing can body processing, which involves a high degree of deformation, and a two-piece can, which is required to have high pressure resistance, and to a method for manufacturing the steel sheet.

BACKGROUND ART

In recent years, in order to expand the demand for steel cans, measures have been taken to decrease can-making costs and to use steel cans for new kinds of cans such as shaped cans.

Examples of the above-described measures to decrease can-making costs include a measure to reduce material costs. Therefore, not only in the case of a two-piece can, which is formed by performing drawing, but also in the case of a three-piece can, which is formed by mainly performing simple cylinder forming, reduction in the thickness of the steel sheet used is in progress.

However, if the thickness of a steel sheet is simply reduced, the strength of a can body decreases. Therefore, it is not possible to use a steel sheet whose thickness is simply reduced for a portion where a high-strength material is used, such as a draw-redraw can (DRD can) or the body of a welded can. Therefore, there is a demand for a high-strength and ultra-thin steel sheet for a can.

Nowadays, a high-strength and ultra-thin steel sheet for a can is manufactured by using a double reduce method (hereinafter, referred to as "DR method") in which secondary cold rolling is performed with a rolling reduction of 20% or more after annealing has been performed. A steel sheet (hereinafter, also referred to as "DR steel sheet") which is manufactured by using a DR method is characterized by having poor formability due to low total elongation (poor ductility) despite having high strength.

On the other hand, it is difficult to use a DR steel sheet, which is poor in terms of ductility, as steel for a can such as a shaped can which is formed by performing body processing involving a high degree of deformation from the viewpoint of formability.

In order to avoid the above-described disadvantage of a DR steel sheet, methods for manufacturing a high-strength steel sheet which utilize various kinds of methods for increasing strength have been proposed.

Patent Literature 1 proposes a steel sheet in which strength and ductility are balanced by utilizing multiple combinations of precipitation strengthening through the use of Nb carbides and grain refining strengthening through the use of the carbonitrides of Nb, Ti, and B.

Patent Literature 2 proposes a method in which strength is increased by utilizing solid solution strengthening through the use of, for example, Mn, P, and N.

Patent Literature 3 proposes a steel sheet for a can in which tensile strength is controlled to be less than 540 MPa by utilizing precipitation strengthening through the use of the carbonitrides of Nb, Ti, and B and in which the formability of a weld is increased by controlling the grain diameter of oxide-based inclusions.

CITATION LIST

Patent Literature

PTL 1: Japanese Unexamined Patent Application Publication No. 8-325670

PTL 2: Japanese Unexamined Patent Application Publication No. 2004-183074

PTL 3: Japanese Unexamined Patent Application Publication No. 2001-89828

SUMMARY

Technical Problem

As described above, it is necessary to achieve high strength in order to realize gauge reduction (thickness reduction). On the other hand, in the case where a steel sheet is used as a material for a can which is formed by performing body processing involving a high degree of deformation (for example, a can body which is formed by performing body processing such as expansion forming, a can body which is formed by performing body processing such as bead processing, or a can body which is formed by performing flange processing), it is necessary to use a high-ductility steel sheet.

For example, in order to prevent the occurrence of cracking in a steel sheet when body processing typified by expansion forming is performed for manufacturing a three-piece can and flange processing or when bottom processing is performed for manufacturing a two-piece can, it is necessary to use a steel sheet having high total elongation as a steel material.

In addition, in consideration of resistance to highly corrosive contents, it is necessary to use a steel sheet having good corrosion resistance.

Regarding the properties described above, the conventional techniques described above are poor in terms of at least one of strength, ductility (total elongation), and corrosion resistance.

In Patent Literature 1, an increase in strength is realized through precipitation strengthening, and steel in which strength and ductility are balanced is proposed. However, it is not possible to achieve satisfactory ductility which is an aim of the present disclosure by using the manufacturing method according to Patent Literature 1.

Patent Literature 2 proposes a method for increasing strength through solid solution strengthening. However, since an excessive amount of P, which is generally known as a chemical element that inhibits corrosion resistance, is added, there is a high risk of an inhibition in corrosion resistance.

In Patent Literature 3, intended strength is achieved by utilizing precipitation strengthening and grain refining strengthening through the use of Nb, Ti, and so forth. Since it is indispensable to add not only Ti but also Ca and REM from the viewpoint of the formability of a weld and surface quality, there is a problem of a decrease in corrosion resistance.

The present disclosure has been completed in view of the situation described above, and an object of the present disclosure is to provide a steel sheet for a can having high strength, excellent ductility, and good corrosion resistance, even on exposure to highly corrosive contents, and a method for manufacturing the steel sheet.

Solution to Problem

The present inventors diligently conducted investigations in order to solve the problems described above and, as a result, obtained the following knowledge.

Consideration was given to the multiple combinations of precipitation strengthening, solid solution strengthening, and work hardening. Then, it was found that it is possible to increase strength without decreasing ductility by utilizing solid solution strengthening through the use of N and by changing a ferrite microstructure through the use of the solute drag of solid solution Nb.

In addition, it was found that it is possible to simultaneously achieve excellent ductility and high strength by controlling the difference in the amount of solid solution Nb between a surface-side portion and a center-side portion in the thickness direction of a steel sheet.

In addition, there is no decrease in corrosion resistance, even on exposure to highly corrosive contents, as a result of designing the chemical composition of a steel sheet so that the contents of constituent chemical elements are within ranges in which corrosion resistance is not impaired.

Moreover, regarding a manufacturing method, it is possible to increase strength without decreasing ductility (without decreasing total elongation) by appropriately controlling an average cooling rate after soaking in an annealing process has been performed.

As described above, it was found that it is possible to manufacture a steel sheet for a can having high ductility and high strength by controlling the chemical composition and the manufacturing method in combination.

The present disclosure has been completed on the basis of the knowledge described above, and the exemplary disclosed embodiments are as follows.

[1] A steel sheet for a can, the steel sheet having a chemical composition containing, by mass %, C: 0.020% or more and 0.130% or less, Si: 0.04% or less, Mn: 0.10% or more and 1.20% or less, P: 0.007% or more and 0.100% or less, S: 0.030% or less, Al: 0.001% or more and 0.100% or less, N: more than 0.0120% and 0.0200% or less, Nb: 0.0060% or more and 0.0300% or less, and the balance being Fe and inevitable impurities, an upper yield strength of 460 MPa to 680 MPa, and a total elongation of 12% or more, in which the absolute value of the difference in the amount of solid solution Nb between a region from the surface to a ⅛ depth position and a region from a ⅜ depth position to a ⅝ depth position is 0.0010 mass % or more.

Here, the terms "⅛ depth position", "⅜ depth position", and "⅝ depth position" respectively denote a position located at ⅛ of the thickness from the surface, a position located at ⅜ of the thickness from the surface, and a position located at ⅝ of the thickness from the surface.

[2] A method for manufacturing the steel sheet for a can according to item [1] above, the method including a hot rolling process of rolling a steel slab with a finish rolling temperature of 820° C. or higher and coiling the hot-rolled steel sheet at a coiling temperature of 500° C. to 620° C., a primary cold rolling process of rolling the hot-rolled steel sheet with a rolling reduction of 80% or more after pickling following the hot rolling process has been performed, an annealing process of annealing the cold-rolled steel sheet with a soaking temperature of 660° C. to 800° C., a soaking time of 55 s or less, and an average cooling rate of 30° C./s or more and less than 150° C./s from the soaking temperature to a cooling stop temperature of 250° C. to 400° C. after the primary cold rolling process, and a secondary cold rolling process of rolling the annealed steel sheet with a rolling reduction of 1% to 19% after the annealing process.

Here, in the present description, "%" used when describing the constituent chemical elements of steel refers to "mass %".

Advantageous Effects

According to the present disclosure, it is possible to obtain a steel sheet for a can having high ductility and high strength in which there is no decrease in corrosion resistance, even on exposure to highly corrosive contents.

Moreover, in the case of the present disclosure, it is possible to achieve a high-strength can body due to an increase in the strength of a steel sheet, even if the can gauge is reduced. In addition, due to high ductility, it is possible to perform intense body processing which are used for a welded can such as expansion forming and bead processing and flange processing.

DESCRIPTION OF EMBODIMENTS

First, the chemical composition of the steel sheet for a can according to the present disclosure will be described.

The steel sheet for a can according to the present disclosure has a chemical composition containing, by mass %, C: 0.020% or more and 0.130% or less, Si: 0.04% or less, Mn: 0.10% or more and 1.20% or less, P: 0.007% or more and 0.100% or less, S: 0.030% or less, Al: 0.001% or more and 0.100% or less, N: more than 0.0120% and 0.0200% or less, Nb: 0.0060% or more and 0.0300% or less, and the balance being Fe and inevitable impurities. In the present disclosure, since strength is increased without decreasing ductility by utilizing solid solution strengthening through the use of N and by changing a ferrite microstructure through the use of the solute drag of solid solution Nb, it is not necessary to add constituent chemical elements other than those described above. For example, since there may be a decrease in ductility and corrosion resistance when Ti or B is added, Ti or B is not added in the present disclosure.

C: 0.020% or More and 0.130% or Less

It is important that the steel sheet for a can according to the present disclosure has an upper yield strength of 460 MPa to 680 MPa and a total elongation of 12% or more. In order to realize this, it is important to utilize precipitation strengthening through the use of NbC, which is formed by adding Nb. In order to utilize precipitation strengthening through the use of NbC, the C content in a steel sheet for a can is important. Specifically, it is necessary that the lower limit of the C content be 0.020%. On the other hand, when the C content is more than 0.130%, hypo-peritectic cracking occurs in the cooling process of a molten-steel-preparation process. Therefore, the upper limit of the C content is set to be 0.130%. Here, when the C content is more than 0.040%, since there is a tendency for resistance to deformation to increase when cold rolling is performed due to an increase in the strength of a hot-rolled steel sheet, there may be a case where it is necessary to decrease a rolling speed in order to avoid surface defects from occurring after rolling has been performed. Therefore, it is preferable that the C content be 0.020% or more and 0.040% or less from the viewpoint of ease of manufacture.

Si: 0.04% or Less

Si is a chemical element which increases the strength of steel through solid solution strengthening. In order to realize such an effect, it is preferable that the Si content be 0.01% or more. However, when the Si content is more than 0.04%, there is a significant decrease in corrosion resistance. Therefore, the Si content is set to be 0.04% or less Mn: 0.10% or More and 1.20% or Less Mn increases the strength of steel through solid solution strengthening. In addition, in order to achieve the intended upper yield strength, it is necessary that the Mn content be 0.10% or more. Therefore, the lower limit of the Mn content is set to be 0.10%. On the other hand, when the Mn content is more than 1.20%, there is a decrease in corrosion resistance and surface quality. Therefore, the upper limit of the Mn content is set to be 1.20%. It is preferable that the Mn content be 0.13% or more and 0.60% or less.

P: 0.007% or More and 0.100% or Less

P is a chemical element which is highly capable of increasing strength through solid solution strengthening. It is necessary that the P content be 0.007% or more in order to realize such an effect. In addition, there is a significant increase in dephosphorization time when the P content is less than 0.007%. Therefore, the P content is set to be 0.007% or more. However, when the P content is more than 0.100%, there is a decrease in corrosion resistance. Therefore, the P content is set to be 0.100% or less. It is preferable that the P content be 0.008% or more and 0.030% or less.

S: 0.030% or Less

In the case of the steel sheet for a can according to the present disclosure, since the contents of C and N are high, and since Nb, which forms precipitates that cause slab cracking, is added, cracking tends to occur on the edges of a slab in the straightening zone in a continuous casting process. In order to prevent slab cracking, the S content is set to be 0.030% or less, preferably 0.020% or less, or more preferably 0.010% or less. On the other hand, since there is an excessive increase in desulfurization costs when the S content is less than 0.005%, it is preferable that the S content be 0.005% or more.

Al: 0.001% or More and 0.100% or Less

When there is an increase in the Al content, since there is an increase in the recrystallization temperature, it is necessary to increase the annealing temperature in accordance with the amount of increase in Al content. In the present disclosure, since there is an increase in the recrystallization temperature due to other chemical elements which are added in order to increase upper yield strength, it is necessary to increase the annealing temperature. Therefore, it is necessary that the amount of increase in the recrystallization temperature due to Al be as small as possible. Therefore, the Al content is set to be 0.100% or less. On the other hand, since it is difficult to completely remove solid solution N, the Al content is set to be 0.001% or more. Here, it is preferable that Al be added as a deoxidizing agent, and it is preferable that the Al content be 0.010% or more in order to realize such an effect.

N: More Than 0.0120% and 0.0200% or Less

N is a chemical element which is necessary for increasing the degree of solid solution strengthening. In order to realize the effect of solid solution strengthening, it is necessary that the N content be more than 0.0120%. On the other hand, when the N content is excessively large, slab cracking tends to occur in the lower straightening zone in a continuous casting process, in which there is a decrease in temperature. Therefore, the N content is set to be 0.0200% or less. It is preferable that the N content be 0.0130% or more and 0.0190% or less.

Nb: 0.0060% or More and 0.0300% or Less

Nb is a chemical element which is highly capable of forming carbides and which is precipitated in the form of fine carbides. With this, there is an increase in upper yield strength. In the present disclosure, it is possible to control upper yield strength through the use of the Nb content. Since such an effect is realized when the Nb content is 0.0060% or more, the lower limit of the Nb content is set to be 0.0060%. On the other hand, since Nb causes an increase in recrystallization temperature, it is difficult to perform annealing when the Nb content is more than 0.0300% because, for example, a large amount of non-recrystallized microstructure is retained when continuous annealing is performed at an annealing temperature of 660° C. to 800° C. for a soaking time of 55 s or less. Therefore, the upper limit of the Nb content is set to be 0.0300%. It is preferable that the Nb content be 0.0070% or more and 0.0250% or less.

The remainder which is different from the constituent chemical elements described above is Fe and inevitable impurities.

Hereafter, the microstructure and properties of the steel sheet according to the present disclosure will be described.

The absolute value of the difference in the amount of solid solution Nb between a region from the surface to a ⅛ depth position and a region from a ⅜ depth position to a ⅝ depth position is 0.0010 mass % or more.

Here, the terms "⅛ depth position", "⅜ depth position", and "⅝ depth position" respectively denote a position located at ⅛ of the thickness from the surface, a position located at ⅜ of the thickness from the surface, and a position located at ⅝ of the thickness from the surface.

It is possible to further increase upper yield strength by increasing the amount of solid solution Nb in a region from a ⅜ depth position to a ⅝ depth position. On the other hand, it is possible to achieve good total elongation (high ductility) by changing the amount of solid solution Nb in a region from the surface to a ⅛ depth position. Therefore, it is considered that, by allowing the amount of solid solution Nb to vary in the thickness direction, it is possible to simultaneously achieve significantly excellent ductility and strength. When the absolute value of the difference in the amount of solid solution Nb in the thickness direction is 0.0010 mass % or more, it is possible to achieve the high ductility (represented by a total elongation of 12% or more) and the high strength (represented by an upper yield strength of 460 MPa to 680 MPa) which are aimed at in the present disclosure. Therefore, the absolute value of the difference in the amount of solid solution Nb is set to be 0.0010 mass % or more, or preferably 0.0023 mass % or more. On the other hand, since it is difficult to simultaneously achieve satisfactory total elongation and upper yield strength when the absolute value of the difference in the amount of solid solution Nb is more than 0.0050 mass %, it is preferable that the absolute value be 0.0050 mass % or less.

Here, the above-described difference in the amount of solid solution Nb decreases with a decrease in average cooling rate after soaking has been performed in an annealing process and increases with an increase in such an average cooling rate.

It is preferable that the amount of solid solution Nb in a region from the surface to a ⅛ depth position be 0.0014 mass % to 0.0105 mass %. By controlling the amount of solid solution Nb in a region from the surface to a ⅛ depth position to be 0.0014 mass % to 0.0105 mass %, it is possible to achieve excellent upper yield strength and total elongation.

It is preferable that the amount of solid solution Nb in a region from a ⅜ depth position to a ⅝ depth position be 0.0017 mass % to 0.0095 mass %.

By controlling the amount of solid solution Nb in a region from a ⅜ depth position to a ⅝ depth position to be 0.0017 mass % to 0.0095 mass %, it is possible to achieve excellent upper yield strength and total elongation.

It is possible to determine the amount of solid solution Nb in a region from the surface to a ⅛ depth position by dissolving a sample to a position located at ⅛ of the thickness through constant-current electrolysis (20 mA/cm$^2$)

in a 10% acetylacetone-1% tetramethylammonium chloride-methanol solution and by performing inductively coupled plasma emission spectrometry on Nb in the electrolytic solution.

It is possible to determine the amount of solid solution Nb in a region from a ⅜ depth position to a ⅝ depth position by performing chemical polishing on a sample to a position located at ⅜ of the thickness through the use of 20 wt. % oxalic acid aqueous solution, by thereafter dissolving the sample to a position located at ⅝ of the thickness through constant-current electrolysis (20 mA/cm$^2$) in a 10% acetylacetone-1% tetramethylammonium chloride-methanol solution, and by performing inductively coupled plasma emission spectrometry on Nb in the electrolytic solution.

In the case of a conventional method for determining the amount of Nb precipitated in which inductively coupled plasma emission spectrometry is performed on Nb in extraction residue which is obtained by dissolving a sample through constant-current electrolysis (20 mA/cm$^2$) in a 10% acetylacetone-1% tetramethylammonium chloride-methanol solution, when Nb precipitates of ten-odd nm to 1 nm are collected by using a filter, some of the precipitates may pass through the filter. Therefore, the sum of the amount of Nb precipitated and the amount of solid solution Nb is not necessarily equal to the total amount of Nb. Therefore, in the present disclosure, inductively coupled plasma emission spectrometry is performed directly on Nb in the electrolytic solution in order to precisely control the amount of solid solution Nb. With this, it is possible to obtain a steel sheet having both satisfactory ductility and strength.

Upper Yield Strength: 460 MPa to 680 MPa

The upper yield strength is set to be 460 MPa or more in order to achieve, for example, satisfactory dent resistance of a welded can and satisfactory pressure resistance of a two-piece can. On the other hand, it is necessary that a large amount of constituent chemical elements be added in order to achieve an upper yield strength of more than 680 MPa. In the case where a large amount of constituent chemical elements is added, there may be an inhibition in the corrosion resistance of the steel sheet for a can according to the present disclosure. Therefore, the upper yield strength is set to be 680 MPa or less. It is possible to control the upper yield strength of a steel sheet for a can to be 460 MPa to 680 MPa by using the chemical composition described above and, for example, the manufacturing conditions described below.

Total Elongation: 12% or More

In the case where the total elongation of a steel sheet for a can is less than 12%, for example, there may be a problem of cracking occurring when a can is manufactured by performing body processing such as bead processing or expansion forming. In addition, in the case where the total elongation is less than 12%, cracking may occur when flange processing is performed on a can. Therefore, the lower limit of the total elongation is set to be 12%. It is possible to control the total elongation to be 12% or more, for example, by controlling a cooling rate after soaking has been performed in annealing and by performing secondary cold rolling with a specified range of rolling reduction after an annealing process. Since excessively high cost for controlling the constituent chemical elements and the manufacturing conditions is required in order to achieve a total elongation of more than 30%, it is preferable that the total elongation be 30% or less.

Thickness: 0.4 mm or Less (Preferable Condition)

Reduction in the thickness of a steel sheet is in progress in order to reduce can-making costs. However, there is a risk of a decrease in the strength of a can body due to reduction in the thickness of a steel sheet, that is, a decrease in the thickness of a steel sheet. In contrast, in the case of the steel sheet for a can according to the present disclosure, there is no decrease in the strength of a can body even with a small thickness. In the case of a small thickness, the effect of the present disclosure represented by high ductility and high strength becomes marked. From this point of view, it is preferable that the thickness be 0.4 mm or less. The thickness may be 0.3 mm or less or 0.2 mm or less.

Hereafter, the method for manufacturing the steel sheet for a can according to the present disclosure will be described.

The method for manufacturing the steel sheet for a can according to the present disclosure includes a hot rolling process of rolling a steel slab having the chemical composition described above with a finish rolling temperature of 820° C. or higher and coiling the hot-rolled steel sheet at a coiling temperature of 500° C. to 620° C., a primary cold rolling process of rolling the hot-rolled steel sheet with a rolling reduction of 80% or more after pickling following the hot rolling process has been performed, an annealing process of annealing the cold-rolled steel sheet with a soaking temperature of 660° C. to 800° C., a holding time of 55 s or less, and an average cooling rate of 30° C./s or more and less than 150° C./s from the soaking temperature to a cooling stop temperature of 250° C. to 400° C. after the primary cold rolling process, and a secondary cold rolling process of rolling the annealed steel sheet with a rolling reduction of 1% to 19% after the annealing process.

Steel which is a raw material to be rolled will be described. The steel is obtained by preparing molten steel having the chemical composition described above through the use of a known molten-steel-preparing method such as one which utilizes a converter and by casting the molten steel into a rolling raw material through the use of a commonly used casting method such as a continuous casting method.

The steel which has been obtained as described above is subjected to a hot rolling process of rolling the steel with a finish rolling temperature of 820° C. or higher and coiling the hot-rolled steel sheet with a coiling temperature of 500° C. to 620° C. in order to obtain a hot-rolled steel sheet. It is preferable that the temperature of the steel be 1200° C. or higher when rolling is started in the hot rolling process.

Finish Rolling Temperature: 820° C. or Higher

The finish rolling temperature of hot rolling is an important factor in order to achieve satisfactory upper yield strength. In the case where the finish rolling temperature is lower than 820° C., since hot rolling is performed in a temperature range in which a dual phase consists of austenite and ferrite ($\gamma+\alpha$) is formed, crystal grain growth occurs, which results in an excessive increase in crystal grain diameter after annealing following cold rolling has been performed. As a result, there is a decrease in upper yield strength. Therefore, the finish rolling temperature of hot rolling is set to be 820° C. or higher. Although there is no particular limitation on the upper limit of the finish rolling temperature, it is preferable that the upper limit of the finish rolling temperature be 980° C. in order to inhibit the generation of scale.

Coiling Temperature: 500° C. to 620° C.

The coiling temperature is important for controlling the upper yield strength and total elongation which are important factors in the present disclosure. In the case where the coiling temperature is lower than 500° C., since the surface layer is rapidly cooled, there is a decrease in the amount of AlN in the surface layer, which results in an increase in the amount of solid solution N in the surface layer. Therefore, the lower limit of the coiling temperature is set to be 500° C. On the other hand, in the case where the coiling temperature is higher than 620° C., since N, which is added for solid solution strengthening, is precipitated in the form of AlN in the central layer, there is a decrease in the amount of solid solution N, which results in a decrease in upper yield strength. Therefore, the upper limit of the coiling temperature is set to be 620° C. It is preferable that the coiling temperature be 520° C. to 600° C.

Subsequently, pickling is performed, and primary cold rolling is then performed with a rolling reduction of 80% or more.

Pickling is performed in order to remove scale. There is no particular limitation on the method for performing pickling. Pickling may be performed by using a commonly used method as long as the surface scale of a steel sheet is removed. In addition, scale may be removed by using a method other than a pickling method.

Rolling Reduction in Cold Rolling: 80% or More

The rolling reduction in the primary cold rolling process is one of the important factors in the present disclosure. In the case where the rolling reduction in the primary cold rolling process is less than 80%, it is difficult to manufacture a steel sheet having an upper yield strength of 460 MPa or more. Moreover, in the case where the rolling reduction in this process is less than 80%, it is necessary that the thickness of a hot-rolled steel sheet be at most 0.9 mm or less in order to obtain a thickness equivalent to the thickness (about 0.17 mm) of a conventional DR steel sheet which is manufactured with a rolling reduction of the secondary cold rolling process of 20% or more. However, it is difficult to control the thickness of a hot-rolled steel sheet to be 0.9 mm or less from the viewpoint of operation. Therefore, the rolling reduction in this process is set to be 80% or more.

Here, other processes may appropriately be included after the hot rolling process and before the primary cold rolling process. In addition, the primary cold rolling process may be performed immediately after the hot rolling process without performing pickling.

Subsequently, annealing is performed with a soaking temperature of 660° C. to 800° C., a holding time of 55 s or less, and an average cooling rate of 30° C./s or more and less than 150° C./s from the soaking temperature to a cooling stop temperature of 250° C. to 400° C.

Soaking Temperature: 660° C. to 800° C.

In order to increase the homogeneity of the microstructure of a steel sheet, the soaking temperature is set to be 660° C. or higher. On the other hand, in the case where annealing is performed with a soaking temperature of higher than 800° C., since it is necessary that the speed of a sheet strip be as small as possible in order to prevent fracture from occurring in the sheet strip, there is a decrease in productivity. Therefore, the soaking temperature is set to be 660° C. to 800° C., or preferably 660° C. to 760° C.

Soaking Time: 55 s or Less

Since it is not possible to achieve satisfactory productivity in the case where the speed of sheet strip corresponds to a soaking time of more than 55 s. Therefore, the soaking time is set to be 55 s or less. There is no particular limitation on the lower limit of the soaking time. However, it is necessary to increase speed of sheet strip in order to decrease the soaking time. In the case where the speed of sheet strip is increased, it is difficult to realize stable feed speed of steel strip without transverse displacement. For the reasons described above, it is preferable that the lower limit of the soaking time be 10 s.

Average Cooling Rate from Soaking Temperature to Cooling Stop Temperature of 250° C. to 400° C.: 30° C./s or More and Less Than 150° C./s A rapid cooling treatment is performed after soaking has been performed. In the case where the cooling rate is large, inhomogeneous distribution in the thickness direction of solid solution Nb occurs. This is considered to be because cooling progresses inhomogeneously in the thickness direction due to a large cooling rate. It is considered that the diffusion of Nb is influenced by inhomogeneous cooling, which results in inhomogeneous distribution of Nb concentration. Solid solution Nb inhibits ferrite grain growth through a solute drag effect so as to influence ferrite grain diameter in a minute region in a very thin surface layer. Moreover, in the present disclosure, there are minute differences in material properties between the surface layer and the central layer due to the inhomogeneous distribution in the thickness direction of solid solution Nb. As a result, it is possible to simultaneously achieve high ductility and high strength. In the case where the cooling rate is less than 30° C./s, since cooling progresses homogeneously in the thickness direction due to the small cooling rate, the inhomogeneous distribution in the thickness direction of solid solution Nb does not occur. As a result, it is difficult to simultaneously achieve high ductility and high strength. Therefore, the cooling rate is set to be 30° C./s or more, preferably 35° C./s or more, or more preferably 40° C./s or more. On the other hand, in the case where the cooling rate is 150° C./s or more, since it is not possible to allow cooling to progress homogeneously in the width direction due to the excessively large cooling rate, there is a variation in material properties due to inhomogeneous distribution of solid solution Nb. Therefore, the cooling rate is set to be less than 150° C./s, preferably 130° C./s or less, or more preferably 120° C./s or less.

The cooling stop temperature is set to be 250° C. to 400° C. from the viewpoint of achieving homogeneous temperature distribution without a variation in the width direction and of the intended strength. This is because, in the case where the cooling stop temperature is lower than 250° C., it is difficult to achieve homogeneous temperature distribution without a variation in the width direction, which results in a variation in upper yield strength in the width direction. In addition, this is because, in the case where the cooling stop temperature is higher than 400° C., there is an increase in the amount of precipitated C due to an over-aging treatment being performed, which results in a decrease in upper yield strength.

Here, continuous annealing equipment is used for annealing. In addition, other processes may appropriately be included after the primary cold rolling process and before the annealing process, or the annealing process may be performed immediately after the primary cold rolling process.

Subsequently, secondary cold rolling is performed with a rolling reduction of 1% to 19%.

Rolling Reduction: 1% to 19%

In the case where the rolling reduction in the secondary cold rolling process following the annealing process is similar to the rolling reduction (20% or more) used for manufacturing an ordinary DR steel sheet, since there is an increase in the amount of strain applied when rolling work is performed, there is a decrease in total elongation. In the present disclosure, since it is necessary to achieve a total elongation of 12% or more for an ultra-thin steel sheet, the rolling reduction in the secondary cold rolling process is set to be 19% or less. In addition, since surface roughness is applied to a steel sheet in the secondary cold rolling process, it is necessary that the rolling reduction in the secondary cold rolling process be 1% or more in order to apply homogeneous surface roughness to a steel sheet. It is preferable that the rolling reduction be 8% to 19%.

Here, other processes may appropriately be included after the annealing process and before the secondary cold rolling process, or the secondary cold rolling process may be performed immediately after the annealing process.

As described above, it is possible to obtain the steel sheet for a can according to the present disclosure. Here, in the present disclosure, various processes may further be performed after the secondary cold rolling process. For example, the steel sheet for a can according to the present disclosure may further have a coating layer on its surface. Examples of a coating layer include a Sn coating layer, a Cr coating layer such as one for tin-free steel, a Ni coating layer, a Sn—Ni coating layer, and so forth. In addition, a process such as a paint baking treatment process and a film-laminating process may be performed.

EXAMPLES

By preparing molten steels having the chemical compositions given in Table 1 with the balance being Fe and inevitable impurities through the use of an actual converter, steel slabs were obtained. The obtained steel slabs were reheated to a temperature of 1200° C. and then subjected to hot rolling. Subsequently, by performing primary cold rolling after pickling had been performed through the use of a commonly used method, steel sheets were manufactured. The obtained steel sheets were heated at a heating rate of 15° C./sec and subjected to continuous annealing. Subsequently, by performing secondary cold rolling after cooling had been performed at a predetermined cooling rate to a cooling stop temperature of 300° C., and by performing an ordinary continuous Sn coating treatment, Sn-coated steel sheets (tin plates) were obtained. Here, the detailed manufacturing conditions are given in Table 2. The term "final thickness" in Table 2 refers to thickness which does not include a Sn coating layer.

By performing a heating treatment which corresponded to a lacquer baking treatment at a temperature of 210° C. for 10 minutes on the Sn-coated steel sheet (tin plate) obtained as described above, and by then performing a tensile test, upper yield strength and total elongation were determined. In addition, pressure resistance, formability, and corrosion resistance were investigated. In addition, the amount of solid solution Nb was determined. The determination methods and the investigation methods were as follows.

Amount of Solid Solution Nb in Region from Surface to ⅛ Depth Position

The amount of solid solution Nb in a region from the surface to a ⅛ depth position was determined by dissolving a sample to a position located at ⅛ of the thickness through constant-current electrolysis (20 mA/cm$^2$) in a 10% acetylacetone-1% tetramethylammonium chloride-methanol solution and by performing inductively coupled plasma emission spectrometry on Nb in the electrolytic solution.

The amount of solid solution Nb in a region from a ⅜ depth position to a ⅝ depth position was determined by performing chemical polishing on a sample to a position located at ⅜ of the thickness through the use of 20 wt. % oxalic acid aqueous solution, by thereafter dissolving the sample to a position located at ⅝ of the thickness through constant-current electrolysis (20 mA/cm$^2$) in a 10% acetylacetone-1% tetramethylammonium chloride-methanol solution, and by performing inductively coupled plasma emission spectrometry on Nb in the electrolytic solution.

Tensile Test

By taking a JIS No. 5 tensile test piece (JIS Z 2201) so that the tensile direction was parallel to the rolling direction, by then performing a heating treatment which corresponded to a lacquer baking treatment at a temperature of 210° C. for 10 minutes on the test piece, and by then performing a tensile test with a cross head speed of 10 mm/min in accordance with JIS Z 2241, upper yield strength (U-YP: upper yield point) and total elongation (El: elongation) were determined.

Pressure Resistance

By performing roll forming so that the bending direction was the rolling direction and the overlapped width was 5 mm, by performing seam welding on both edges of the formed cylinder through the use of an electric resistance welding method, by performing neck forming, and by performing flange forming, and by then seaming a lid to the can body, an empty can sample was manufactured. By charging the obtained empty can sample into a chamber, and by pressurizing the sample with compressed air, a pressure with which buckling occurred in the sample was determined after pressurizing had been performed. A case where the pressure at the time of buckling was 0.20 MPa or more was judged as satisfactory (⊙), a case where the pressure at the time of buckling was less than 0.20 MPa and 0.13 MPa or more was judged as satisfactory (○), and a case where the pressure at the time of buckling was less than 0.13 MPa was judged as unsatisfactory (×).

Formability

By performing roll forming so that the bending direction was the rolling direction and the overlapped width was 5 mm, by performing seam welding on both edges of the formed cylinder through the use of an electric resistance welding method, and by performing neck forming, wrinkles were subjected to visual observation when neck forming was performed. A case where no wrinkle was identified through a visual observation was judged as satisfactory (⊙), a case where one micro-wrinkle was identified through a visual observation was judged as satisfactory (○), and a case where two or more micro-wrinkles were identified through a visual observation was judged as unsatisfactory (×).

Corrosion Resistance

By performing Sn coating on the annealed sample with a coating weight of 11.2 g/m$^2$ per side, the number of hole-like portions where a Sn coating layer was thin was counted. The observation was performed by using an optical microscope at a magnification of 50 times in an observation area of 2.7 mm$^2$. A case where the number was 20 or less was judged as ○, and a case where the number was 21 or more was judged as ×.

The results obtained as described above are given in Table 3.

TABLE 1

| No | Chemical Composition (mass %) C | Si | Mn | P | S | Al | Nb | N | Note |
|---|---|---|---|---|---|---|---|---|---|
| A | 0.029 | 0.01 | 0.35 | 0.010 | 0.010 | 0.041 | 0.0011 | 0.0017 | Comparative Steel |
| B | 0.040 | 0.01 | 0.35 | 0.010 | 0.010 | 0.041 | 0.0032 | 0.0017 | Comparative Steel |
| C | 0.030 | 0.01 | 0.09 | 0.010 | 0.010 | 0.041 | 0.0032 | 0.0017 | Comparative Steel |
| D | 0.030 | 0.01 | 0.81 | 0.010 | 0.010 | 0.041 | 0.0032 | 0.0017 | Comparative Steel |
| E | 0.030 | 0.01 | 0.35 | 0.010 | 0.010 | 0.041 | 0.0032 | 0.0210 | Comparative Steel |
| F | 0.030 | 0.01 | 0.35 | 0.010 | 0.010 | 0.041 | 0.0100 | 0.0189 | Example Steel |
| G | 0.030 | 0.01 | 0.35 | 0.010 | 0.010 | 0.041 | 0.0300 | 0.0130 | Example Steel |
| H | 0.030 | 0.01 | 0.35 | 0.010 | 0.010 | 0.041 | 0.0311 | 0.0130 | Comparative Steel |
| M | 0.030 | 0.01 | 1.20 | 0.010 | 0.010 | 0.041 | 0.0100 | 0.0189 | Example Steel |
| N | 0.030 | 0.01 | 1.30 | 0.010 | 0.010 | 0.041 | 0.0100 | 0.0189 | Comparative Steel |
| O | 0.030 | 0.01 | 0.35 | 0.100 | 0.010 | 0.041 | 0.0100 | 0.0189 | Example Steel |
| P | 0.030 | 0.01 | 0.35 | 0.110 | 0.010 | 0.041 | 0.0100 | 0.0189 | Comparative Steel |
| Q | 0.030 | 0.01 | 0.35 | 0.010 | 0.010 | 0.001 | 0.0100 | 0.0189 | Example Steel |
| R | 0.030 | 0.01 | 0.35 | 0.010 | 0.010 | 0.0004 | 0.0100 | 0.0189 | Comparative Steel |
| S | 0.030 | 0.01 | 0.35 | 0.010 | 0.010 | 0.041 | 0.0100 | 0.0110 | Comparative Steel |
| T | 0.073 | 0.01 | 0.38 | 0.147 | 0.010 | 0.040 | 0.0100 | 0.0130 | Comparative Steel |
| U | 0.039 | 0.01 | 0.33 | 0.009 | 0.010 | 0.041 | 0.0160 | 0.0145 | Example Steel |

TABLE 2

| No | Steel Grade | Hot Rolling Process: Hot Finish Rolling Temperature ° C. | Hot Rolling Process: Coiling Temperature ° C. | Hot Rolling Process: Hot-rolled Thickness mm | Primary Cold Rolling Process: Primary Cold Rolling Reduction % | Annealing Process: Soaking Temperature ° C. | Annealing Process: Soaking Time s | Cooling Rate after Soaking ° C./s | Secondary Cold Rolling Process: Secondary Cold Rolling Reduction % | Final Thickness mm | Note |
|---|---|---|---|---|---|---|---|---|---|---|---|
| 1 | A | 870 | 560 | 2.1 | 91.4 | 710 | 15 | 40 | 6 | 0.170 | Comparative Example |
| 2 | B | 870 | 560 | 2.1 | 91.4 | 710 | 15 | 40 | 6 | 0.170 | Comparative Example |
| 3 | C | 870 | 560 | 2.1 | 91.4 | 710 | 15 | 40 | 6 | 0.170 | Comparative Example |
| 4 | D | 870 | 560 | 2.1 | 91.4 | 710 | 15 | 40 | 6 | 0.170 | Comparative Example |
| 5 | E | 870 | 560 | 2.1 | 91.4 | 710 | 15 | 40 | 6 | 0.170 | Comparative Example |
| 6 | F | 870 | 560 | 2.1 | 91.4 | 710 | 15 | 20 | 6 | 0.170 | Comparative Example |
| 7 | F | 870 | 560 | 2.1 | 91.4 | 710 | 15 | 40 | 6 | 0.170 | Example |
| 8 | F | 870 | 490 | 2.1 | 91.4 | 710 | 15 | 40 | 6 | 0.170 | Comparative Example |
| 9 | F | 810 | 560 | 2.1 | 91.4 | 710 | 15 | 40 | 6 | 0.170 | Comparative Example |
| 10 | F | 870 | 640 | 2.1 | 91.4 | 710 | 15 | 40 | 6 | 0.170 | Comparative Example |
| 11 | F | 870 | 560 | 2.1 | 91.4 | 710 | 15 | 40 | 1.4 | 0.178 | Example |
| 12 | F | 870 | 560 | 2.1 | 91.4 | 710 | 15 | 30 | 6 | 0.170 | Example |
| 13 | G | 870 | 560 | 2.1 | 91.4 | 710 | 15 | 40 | 6 | 0.170 | Example |
| 14 | H | 870 | 560 | 2.1 | 91.4 | 710 | 15 | 40 | 6 | 0.170 | Comparative Example |
| 15 | M | 870 | 560 | 2.1 | 91.4 | 710 | 15 | 40 | 6 | 0.170 | Example |
| 16 | N | 870 | 560 | 2.1 | 91.4 | 710 | 15 | 40 | 6 | 0.170 | Comparative Example |
| 17 | O | 870 | 560 | 2.1 | 91.4 | 710 | 15 | 40 | 6 | 0.170 | Example |
| 18 | P | 870 | 560 | 2.1 | 91.4 | 710 | 15 | 40 | 6 | 0.170 | Comparative Example |
| 19 | Q | 870 | 560 | 2.1 | 91.4 | 710 | 15 | 40 | 6 | 0.170 | Example |
| 20 | R | 870 | 560 | 2.1 | 91.4 | 710 | 15 | 40 | 6 | 0.170 | Comparative Example |
| 21 | S | 870 | 560 | 2.1 | 91.4 | 710 | 15 | 40 | 6 | 0.170 | Comparative Example |
| 22 | F | 870 | 560 | 2.1 | 91.4 | 710 | 15 | 40 | 6 | 0.170 | Example |
| 23 | T | 870 | 560 | 2.5 | 88.4 | 710 | 15 | 40 | 38 | 0.180 | Comparative Example |
| 24 | U | 870 | 580 | 2.1 | 91.4 | 710 | 15 | 40 | 6 | 0.170 | Example |

TABLE 3

| No | Steel Grade | Upper Yield Strength MPa | Total Elongation % | Total Amount of Nb of Whole Thickness mass % | Amount of Solid Solution Nb: Solid Solution Nb of Whole Thickness mass % | Layer 1 (Surface to 1/8 Depth) mass % | Layer 2 (3/8 Depth to 4/8 Depth) mass % | \|Layer 1 − Layer 2\| Absolute Value mass % | Pressure Resistance | Formability | Corrosion Resistance | Note |
|---|---|---|---|---|---|---|---|---|---|---|---|---|
| 1 | A | 464 | 11 | 0.0011 | 0.0003 | 0.0005 | 0.0006 | 0.0001 | X | X | ○ | Comparative Example |
| 2 | B | 530 | 10 | 0.0032 | 0.0009 | 0.0017 | 0.0008 | 0.0009 | ○ | X | ○ | Comparative Example |
| 3 | C | 465 | 11 | 0.0032 | 0.0009 | 0.0017 | 0.0007 | 0.0010 | X | X | ○ | Comparative Example |

TABLE 3-continued

| No | Steel Grade | Upper Yield Strength MPa | Total Elongation % | Total Amount of Nb of Whole Thickness mass % | Solid Solution Nb of Whole Thickness mass % | Amount of Solid Solution Nb: Layer 1 (Surface to ⅛ Depth) mass % | Amount of Solid Solution Nb: Layer 2 (⅜ Depth to ⅝ Depth) mass % | Amount of Solid Solution Nb: \|Layer 1 − Layer 2\| Absolute Value mass % | Pressure Resistance | Formability | Corrosion Resistance | Note |
|---|---|---|---|---|---|---|---|---|---|---|---|---|
| 4 | D | 510 | 10 | 0.0032 | 0.0009 | 0.0017 | 0.0008 | 0.0009 | ○ | X | ○ | Comparative Example |
| 5 | E | 530 | 11 | 0.0032 | 0.0009 | 0.0017 | 0.0008 | 0.0009 | ○ | X | ○ | Comparative Example |
| 6 | F | 510 | 11 | 0.0100 | 0.0030 | 0.0030 | 0.0030 | 0.0000 | ○ | X | ○ | Comparative Example |
| 7 | F | 510 | 12 | 0.0100 | 0.0030 | 0.0035 | 0.0019 | 0.0016 | ○ | ○ | ○ | Example |
| 8 | F | 510 | 11 | 0.0100 | 0.0030 | 0.0035 | 0.0019 | 0.0016 | ○ | X | ○ | Comparative Example |
| 9 | F | 457 | 14 | 0.0100 | 0.0030 | 0.0040 | 0.0020 | 0.0020 | X | ○ | ○ | Comparative Example |
| 10 | F | 459 | 14 | 0.0100 | 0.0030 | 0.0045 | 0.0018 | 0.0027 | X | ○ | ○ | Comparative Example |
| 11 | F | 461 | 12 | 0.0100 | 0.0030 | 0.0035 | 0.0017 | 0.0018 | ○ | ○ | ○ | Example |
| 12 | F | 521 | 12 | 0.0100 | 0.0030 | 0.0015 | 0.0036 | 0.0021 | ○ | ○ | ○ | Example |
| 13 | G | 540 | 12 | 0.0300 | 0.0090 | 0.0095 | 0.0085 | 0.0010 | ○ | ○ | ○ | Example |
| 14 | H | 545 | 11 | 0.0311 | 0.0093 | 0.0098 | 0.0090 | 0.0008 | ○ | X | ○ | Comparative Example |
| 15 | M | 540 | 12 | 0.0100 | 0.0030 | 0.0105 | 0.0095 | 0.0010 | ⊙ | ○ | ○ | Example |
| 16 | N | 550 | 11 | 0.0100 | 0.0030 | 0.0105 | 0.0095 | 0.0010 | ○ | X | X | Comparative Example |
| 17 | O | 510 | 14 | 0.0100 | 0.0030 | 0.0105 | 0.0095 | 0.0010 | ○ | ⊙ | ○ | Example |
| 18 | P | 510 | 11 | 0.0100 | 0.0030 | 0.0105 | 0.0095 | 0.0010 | ○ | X | X | Comparative Example |
| 19 | Q | 510 | 14 | 0.0100 | 0.0030 | 0.0105 | 0.0095 | 0.0010 | ○ | ⊙ | ○ | Example |
| 20 | R | 459 | 14 | 0.0100 | 0.0030 | 0.0105 | 0.0095 | 0.0010 | X | ○ | ○ | Comparative Example |
| 21 | S | 458 | 14 | 0.0100 | 0.0030 | 0.0105 | 0.0095 | 0.0010 | X | ○ | ○ | Comparative Example |
| 22 | F | 541 | 14 | 0.0100 | 0.0030 | 0.0014 | 0.0037 | 0.0023 | ⊙ | ⊙ | ○ | Example |
| 23 | T | 688 | 1 | 0.0100 | 0.0030 | 0.0105 | 0.0095 | 0.0010 | ○ | ○ | X | Comparative Example |
| 24 | U | 593 | 13 | 0.0100 | 0.0030 | 0.0105 | 0.0095 | 0.0010 | ⊙ | ⊙ | ○ | Example |

As indicated in Table 3, in the case of the examples of the present disclosure, high-strength steel sheets for a can having good corrosion resistance and high ductility were obtained.

INDUSTRIAL APPLICABILITY

According to the present disclosure, it is possible to obtain a steel sheet for a can having high strength, excellent ductility, and good corrosion resistance, even on exposure to highly corrosive contents. The present disclosure is most suitable for a steel sheet for a can including a three-piece can with body processing which involves a high degree of deformation, and a two-piece can, whose bottom is subjected to forming which involves a strain of several percent.

The invention claimed is:

1. A steel sheet for a can, the steel sheet comprising:

a chemical composition including:

C: 0.020% or more and 0.130% or less, by mass %,

Si: 0.04% or less, by mass %,

Mn: 0.10% or more and 1.20% or less, by mass %,

P: 0.007% or more and 0.100% or less, by mass %,

S: 0.030% or less, by mass %,

Al: 0.001% or more and 0.100% or less, by mass %,

N: more than 0.0120% and 0.0200% or less, by mass %,

Nb: 0.0060% or more and 0.0300% or less, by mass %, and

Fe and inevitable impurities, wherein:

the steel sheet has an upper yield strength of 460 MPa to 680 MPa, the steel sheet has a total elongation of 12% or more, and an absolute value of a difference in an amount of solid solution Nb between a region from a surface of the steel sheet to a ⅛ depth position and a region from a ⅜ depth position to a ⅝ depth position is 0.0010 mass % or more, where, the terms "⅛ depth position", "⅜ depth position", and "⅝ depth position" respectively denote a position located at ⅛ of a thickness from the surface of the steel sheet, a position located at ⅜ of the thickness from the surface of the steel sheet, and a position located at ⅝ of the thickness from the surface of the steel sheet.

2. A method for manufacturing the steel sheet according to claim 1, the method comprising:

a hot rolling process of rolling a steel slab with a finish rolling temperature of 820° C. or higher and coiling the hot-rolled steel sheet at a coiling temperature of 500° C. to 620° C., the steel slab having a chemical composition including:

C: 0.020% or more and 0.130% or less, by mass %,

Si: 0.04% or less, by mass %,

Mn: 0.10% or more and 1.20% or less, by mass %,

P: 0.007% or more and 0.100% or less, by mass %,

S: 0.030% or less, by mass %,

Al: 0.001% or more and 0.100% or less, by mass %,

N: more than 0.0120% and 0.0200% or less, by mass %,

Nb: 0.0060% or more and 0.0300% or less, by mass %, and

Fe and inevitable impurities, after the hot rolling process, pickling the steel sheet, a primary cold rolling process of rolling the hot-rolled steel sheet with a rolling reduction of 80% or more after the pickling, an annealing process of annealing the cold-rolled steel sheet with a soaking temperature of 660° C. to 800° C., a soaking time of 55 s or less, and an average cooling rate of 30° C./s or more and less than 150° C./s from the soaking temperature to a cooling stop temperature of 250° C. to 400° C. after the primary cold rolling process, and a secondary cold rolling process of rolling the annealed steel sheet with a rolling reduction of 1% to 19% after the annealing process.

3. The steel sheet according to claim 1, wherein the absolute value of the difference in the amount of solid solution Nb between the region from the surface of the steel sheet to the ⅛ depth position and the region from the ⅜ depth position to the ⅝ depth position is 0.0023 mass % or more and 0.0050 mass % or less.

4. The method according to claim 3, wherein the absolute value of the difference in the amount of solid solution Nb between the region from the surface of the steel sheet to the ⅛ depth position and the region from the ⅜ depth position to the ⅝ depth position is 0.0023 mass % or more and 0.0050 mass % or less.

* * * * *